US011697035B2

(12) United States Patent
Weber et al.

(10) Patent No.: US 11,697,035 B2
(45) Date of Patent: Jul. 11, 2023

(54) CHEMICAL PROTECTIVE PONCHO SYSTEM

(71) Applicants: Brian Michael Weber, Robins, IA (US); Marci Anne Waterman, Marion, IA (US)

(72) Inventors: Brian Michael Weber, Robins, IA (US); Marci Anne Waterman, Marion, IA (US)

(73) Assignee: Polo Custom Products, Inc., Topeka, KS (US)

( * ) Notice: Subject to any disclaimer, the term of this patent is extended or adjusted under 35 U.S.C. 154(b) by 399 days.

(21) Appl. No.: 16/825,018

(22) Filed: Mar. 20, 2020

(65) Prior Publication Data

US 2020/0316412 A1 Oct. 8, 2020

Related U.S. Application Data

(60) Provisional application No. 62/822,383, filed on Mar. 22, 2019.

(51) Int. Cl.
*A62B 17/00* (2006.01)
*A62B 17/04* (2006.01)
(Continued)

(52) U.S. Cl.
CPC ..... *A62B 17/006* (2013.01); *A41D 3/02* (2013.01); *A62B 7/10* (2013.01); *A62B 17/04* (2013.01); *A62B 23/02* (2013.01)

(58) Field of Classification Search
CPC ..... A62B 17/00; A62B 17/001; A62B 17/006; A62B 17/04; A62B 23/02; A41D 3/04;
(Continued)

(56) References Cited

U.S. PATENT DOCUMENTS 1,772,298 A * 8/1930 Werber ..... A41D 3/06 2/86
2,004,765 A * 6/1935 Molter ..... A62B 17/001 2/82
(Continued)

FOREIGN PATENT DOCUMENTS

CA 1207736 7/1986
CH 214290 A * 4/1941 ..... A62B 17/006
(Continued)

*Primary Examiner* — Heather Mangine
(74) *Attorney, Agent, or Firm* — Christopher A. Proskey; BrownWinick Law Firm

(57) ABSTRACT

A chemical protective poncho system for encapsulating a patient is presented. The system has a body extending a length between a top end and a bottom end and having a hood attached near the top end and having a liner attached near the bottom end. The system includes a layer of adsorbent impregnated media capable of filtering chemical agents while allowing oxygen and carbon dioxide to pass through the material. The chemical protective poncho is specially adapted to fit over the top of a patient and chemically seal the lower portion of the patient while allowing the patient ambulatory freedom. The system also includes ports for intravenous access as well as a port for respiratory access. The system may also include a powered air purifying respirator which positively pressurizes the interior space of the system.

32 Claims, 8 Drawing Sheets

(51) Int. Cl.
*A41D 3/02* (2006.01)
*A62B 7/10* (2006.01)
*A62B 23/02* (2006.01)

(58) Field of Classification Search
CPC ..... A41D 3/06; A41D 3/08; A41D 2300/322; A41D 15/002; A41D 15/005
See application file for complete search history.

(56) References Cited

U.S. PATENT DOCUMENTS 2,314,830 A 3/1943 Hunter
2,791,776 A * 5/1957 Kampherbeek ..... A41D 3/08 2/87
2,967,306 A * 1/1961 Fabanich ..... A41D 3/08 2/87
3,119,358 A 1/1964 Colson
3,849,803 A * 11/1974 Connors ..... A41D 3/08 2/84
3,883,896 A * 5/1975 Cain ..... A41D 15/002 2/74
3,911,913 A * 10/1975 June ..... B63C 9/1055 D29/100
4,236,514 A * 12/1980 Moretti ..... A62B 17/04 2/205
4,272,851 A * 6/1981 Goldstein ..... A62B 17/001 2/82
4,390,996 A * 7/1983 Read ..... A41D 3/06 2/70
4,484,362 A * 11/1984 Asher ..... A45F 3/22 5/413 R
4,485,806 A * 12/1984 Akers ..... A62B 17/001 600/21
4,625,468 A * 12/1986 Hampel ..... E04H 15/56 135/94
4,628,545 A * 12/1986 Metzler ..... A41H 37/003 2/265
4,831,664 A * 5/1989 Suda ..... A62B 17/006 2/457
5,003,973 A * 4/1991 Ford ..... A62B 17/04 2/5
5,005,216 A * 4/1991 Blackburn ..... A62B 17/006 2/457
5,009,869 A * 4/1991 Weinberg ..... B01D 53/34 423/220
5,042,474 A * 8/1991 Williamson ..... A41D 13/1184 55/DIG. 35
5,082,721 A * 1/1992 Smith, Jr. ..... D06N 3/047 2/81
5,088,115 A * 2/1992 Napolitano ..... A62B 17/006 2/84
5,090,057 A * 2/1992 Aldridge ..... A62B 17/001 2/232
5,101,513 A * 4/1992 Bowers ..... A41D 3/08 2/87
5,127,106 A * 7/1992 Aldridge ..... A62B 17/001 2/96
5,206,958 A * 5/1993 Widenback ..... A41D 3/08 2/202
5,331,991 A 7/1994 Nisson
5,355,875 A * 10/1994 Siegel ..... A62B 18/10 128/205.24
5,529,823 A * 6/1996 Aumann ..... A41D 3/04 2/81
5,662,372 A * 9/1997 Lubkeman ..... A41D 3/08 296/136.04
5,706,846 A 1/1998 Sutton
6,032,285 A * 3/2000 Densen ..... A41D 13/02 2/456
6,076,571 A * 6/2000 Burns ..... A62B 17/006 141/383
6,088,833 A * 7/2000 Welchel ..... A41D 13/0002 2/457
6,119,408 A * 9/2000 Page ..... E04H 15/22 52/2.17
6,185,743 B1 * 2/2001 Mick ..... A41D 3/08 2/84
6,438,900 B1 * 8/2002 Page ..... E04H 15/22 52/2.16
6,461,510 B1 * 10/2002 Boles ..... B01D 53/84 210/197
6,571,432 B1 * 6/2003 Rindle ..... A41F 1/00 24/389
6,675,390 B1 * 1/2004 Chang ..... A41D 3/00 2/96
6,715,160 B2 * 4/2004 Crye ..... A62B 17/006 2/457
6,748,609 B1 * 6/2004 Garigan ..... A62B 17/006 2/457
6,859,942 B1 * 3/2005 Cratty ..... A41D 3/08 2/88
7,549,431 B1 * 6/2009 Farnworth ..... A62B 31/00 5/413 R
7,647,656 B2 * 1/2010 Smith ..... A41D 15/04 5/413 R
7,722,705 B2 * 5/2010 Gadkaree ..... B01D 53/06 95/134
7,725,952 B1 * 6/2010 Wight ..... A41D 3/06 2/93
7,832,032 B2 * 11/2010 Haislip ..... A41D 15/04 5/413 R
9,642,420 B2 * 5/2017 McLachlan ..... A44B 18/0003
10,138,653 B1 11/2018 Weber
10,391,737 B2 8/2019 Calomino
2002/0174888 A1 11/2002 Brown
2004/0006815 A1 * 1/2004 Carroll ..... A62B 17/006 2/457
2004/0074529 A1 4/2004 Levy
2004/0133960 A1 * 7/2004 Rausch ..... A41D 13/02 2/69
2004/0139528 A1 * 7/2004 Hord ..... A44B 19/32 2/96
2005/0102729 A1 * 5/2005 Snedeker ..... A41D 13/0002 2/96
2005/0208854 A1 * 9/2005 Sadato ..... B32B 7/12 442/261
2006/0059601 A1 * 3/2006 Opitz ..... A41F 1/00 2/108
2006/0277668 A1 * 12/2006 Plut ..... A41D 13/1218 2/457
2006/0285774 A1 * 12/2006 Carmody ..... B65F 1/0006 383/4
2008/0115261 A1 * 5/2008 Grilliot ..... A41D 27/02 2/81
2008/0216218 A1 * 9/2008 McKinney ..... A62D 5/00 2/457
2009/0205117 A1 * 8/2009 Day ..... A62B 17/00 2/457
2010/0077529 A1 * 4/2010 Stone ..... A62D 5/00 428/305.5
2010/0122393 A1 * 5/2010 Light ..... A41D 13/0015 2/84
2010/0162895 A1 * 7/2010 Bohringer ..... B01J 20/28033 2/457
2010/0251466 A1 * 10/2010 Langley ..... A41D 13/00 428/36.1
2010/0269312 A1 * 10/2010 Wagner ..... A41H 37/003 24/301
2010/0299826 A1 12/2010 Vladimir
2010/0313323 A1 * 12/2010 Tennelle ..... A41D 15/002 2/69
2011/0179548 A1 * 7/2011 Weston ..... A45F 4/14 2/84
2011/0225712 A1 * 9/2011 Rawlings ..... A62B 17/04 2/457
2011/0258749 A1 * 10/2011 Hibbs ..... A41D 15/04 2/84
2012/0084905 A1 * 4/2012 von Blucher ..... A62B 17/006 2/457

(56) References Cited

U.S. PATENT DOCUMENTS

2014/0182050 A1* 7/2014 Ameil ..... A62D 5/00 2/457
2014/0216512 A1* 8/2014 Tallon ..... A45F 4/12 190/1
2014/0310850 A1* 10/2014 Hudak ..... A41D 13/1245 2/114
2015/0174434 A1* 6/2015 Condon ..... A62B 17/005 2/457
2015/0231419 A1* 8/2015 Allan ..... A62B 17/005 128/201.29
2016/0050995 A1* 2/2016 Bentley ..... A41D 27/207 2/114
2016/0165973 A1* 6/2016 Yazdi ..... A41D 13/02 2/457
2016/0199674 A1* 7/2016 Johnson ..... A43B 3/18 2/457
2018/0207613 A1* 7/2018 Böhringer ..... C09J 7/38
2018/0214720 A1* 8/2018 Gooi ..... A41D 31/04
2018/0255853 A1* 9/2018 Spathas ..... B65D 33/00
2018/0345050 A1* 12/2018 Cox ..... A43B 3/16
2019/0037945 A1* 2/2019 Han ..... B32B 37/1207
2019/0150628 A1* 5/2019 Wennerström ..... B01D 53/04
2019/0151685 A1* 5/2019 Kumar ..... A62B 7/10
2019/0200572 A1* 7/2019 Criswell ..... A01K 13/006
2020/0063429 A1 2/2020 Carter
2020/0113251 A1* 4/2020 Burris ..... A41D 3/06
2020/0221802 A1* 7/2020 They ..... A41D 1/06
2020/0316412 A1* 10/2020 Weber ..... A41D 13/0002
2020/0360737 A1* 11/2020 Weber ..... B32B 5/024
2021/0038927 A1* 2/2021 Bourque ..... A62B 17/003
2022/0160059 A1* 5/2022 Arangdad ..... A62B 17/006

FOREIGN PATENT DOCUMENTS

DE 202011004849 U1 * 7/2011 ..... A41D 3/06
DE 102010053313 A1 * 5/2012 ..... A62B 17/006
DE 102011122500 A1 * 7/2013 ..... A62B 17/006
GB 2149290 A * 6/1985 ..... A41D 15/002
WO 1993010896 6/1993
WO 2007080409 7/2007

* cited by examiner

CHEMICAL PROTECTIVE PONCHO SYSTEM

CROSS REFERENCE TO RELATED APPLICATIONS

This application claims benefit to U.S. Provisional Application No. 62/822,383, which was filed on Mar. 22, 2019, the entirety of which is incorporated herein fully by reference.

FIELD OF THE DISCLOSURE

This disclosure relates to chemical protective systems used in warfare and elsewhere. More specifically, and without limitation, this disclosure relates to a chemical protective poncho system for use in encapsulating patients.

OVERVIEW

Chemical warfare is a growing concern. Chemical warfare involves using the toxic properties of chemicals as weapons. Biological warfare involves using biological agents as weapons. Nuclear warfare involves using the radioactive and/or nuclear materials as weapons. Nuclear, biological and chemical warfare are distinct from conventional warfare in that patients on the battle field can become contaminated which presents unique challenges and risks to the patient as well as first responders, doctors, nurses and other people helping the patient. With proper protective equipment, training, and decontamination measures, the primary effects of chemical, biological and nuclear weapons can be overcome. For purposes of simplicity, chemical weapons and chemical warfare shall be primarily referred to herein. However, it is to be understood that unless specifically stated otherwise, the teachings and disclosure provided herein apply to chemical, biological and nuclear weapons and chemical, biological and nuclear contamination.

Although the use of chemical weapons is prohibited under international humanitarian law, chemical weapons continue to be a threat that armed forces need to be prepared to face. To protect against these threats, warfighters wear protective clothing as well as gas masks that block the chemical agents from reaching and injuring the warfighter.

Protective clothing is effective at preventing the effects of chemical weapons on warfighters. However, if the warfighter is injured, and their protective clothing is punctured or compromised, the warfighter must be treated as well as protected from the chemical weapons.

Conventionally, when a warfighter is injured when chemical weapons are present, or the threat of chemical exposure exists, the wounded warfighter is placed in a Chemical Protective Patient Wrap. A chemical protective patient wrap is essentially a bag that the warfighter is placed inside of Not only does this make the warfighter non-ambulatory, this requires other warfighters to carry the injured warfighter off the battlefield. As such, an injury to a single warfighter can take several warfighters out of the fight. This is highly undesirable and inefficient. This is especially true when the injured warfighter is still mobile and capable of getting themselves off of the battle field, to a casualty collection point, or to the medevac such as in some cases where the warfighter is injured in the arm or upper body.

However, presently there are no systems or processes available to cover and shield an injured and exposed warfighter from chemical exposure while also allowing the injured warfighter to remain mobile.

Therefore, for all the reasons stated above, and all the reasons stated below, there is a need in the art for a chemical protective poncho system for protecting wounded but otherwise ambulatory patients from contamination while still enabling patients to be mobile.

Thus, it is an object of the disclosure to provide a chemical protective poncho system for a patient that improves upon the state of the art.

Another object of the disclosure is to provide a chemical protective poncho system for a patient that enables a patient to be mobile.

Yet another object of the disclosure is to provide chemical protective poncho system for a patient that allows a patient to be ambulatory after an injury.

Another object of the disclosure is to provide a chemical protective poncho system for a patient that allows a patient to have visual access to the outside world.

Yet another object of the disclosure is to provide chemical protective poncho system for a patient that allows war fighters and medical staff to have visual access to the patient on the interior space of the system.

Another object of the disclosure is to provide a chemical protective poncho system for a patient that prevents claustrophobia.

Yet another object of the disclosure is to provide chemical protective poncho system for a patient that has a permeable material surface.

Another object of the disclosure is to provide a chemical protective poncho system for a patient that can be easily opened and closed or donned and doffed.

Yet another object of the disclosure is to provide chemical protective poncho system for a patient that has a port for medical and other devices.

Another object of the disclosure is to provide a chemical protective poncho system for a patient that can quickly and efficiently seal around the waist of a patient.

Yet another object of the disclosure is to provide chemical protective poncho system for a patient that can adapt to other military issue clothing.

Another object of the disclosure is to provide a chemical protective poncho system for a patient that protects from nuclear, biological and chemical attacks.

Yet another object of the disclosure is to provide chemical protective poncho system for a patient that helps a team handle a nonambulatory patient.

Another object of the disclosure is to provide a chemical protective poncho system for a patient that is robust.

Yet another object of the disclosure is to provide a chemical protective poncho for a patient that works effectively.

Another object of the disclosure is to provide a chemical protective poncho system for a patient that is durable.

Yet another object of the disclosure is to provide a chemical protective poncho for a patient that can be used safely.

Another object of the disclosure is to provide a chemical protective poncho system for a patient that can be used in association with patients of varying sizes and dimensions.

Yet another object of the disclosure is to provide a chemical protective poncho f for a patient that has a long shelf life.

Another object of the disclosure is to provide a chemical protective poncho system for a patient that provides visual access to and from the patient.

Yet another object of the disclosure is to provide a chemical protective poncho for a patient that is easily portable.

Another object of the disclosure is to provide a chemical protective poncho system for a patient that filters air entering the interior of the system to a safe level for breathing.

Yet another object of the disclosure is to provide a chemical protective poncho for a patient that is efficient to use.

Another object of the disclosure is to provide a chemical protective poncho system for a patient that improves the safety of not only the patient but the safety of those assisting the patient.

Yet another object of the disclosure is to provide a chemical protective poncho for a patient that can be used in practically any environment.

Another object of the disclosure is to provide a chemical protective poncho system for patient that does not cause any kind of suffocation or percentage of suffocation.

Yet another object of the disclosure is to provide a chemical protective poncho for a patient that is relatively affordable.

Another object of the disclosure is to provide a chemical protective poncho system for a patient that is high in quality.

Yet another object of the disclosure is to provide a chemical protective poncho for a patient that works effectively with a powered air purifying respirator.

Another object of the disclosure is to provide a chemical protective poncho system for a patient that works effectively with medical equipment.

Yet another object of the disclosure is to provide a chemical protective poncho for a patient that is wrapped in an impervious wrap kit.

These and other objects, features, or advantages of the disclosure will become apparent from the specification, figures and claims.

SUMMARY OF THE DISCLOSURE

A chemical protective poncho system for encapsulating an uncontaminated or decontaminated patient is presented. The chemical protective poncho system having a body extending a length between a top end and a bottom end and having a hood attached near the top end and having a liner attached near the bottom end. The chemical protective poncho system includes a layer of media impregnated with a chemical adsorbent material capable of filtering chemical agents while allowing oxygen and carbon dioxide to pass through the material. The chemical protective poncho may be specially adapted to fit over the top of a patient and chemically seal the lower portion of the patient while allowing the patient ambulatory freedom. The system also includes ports for intravenous access as well as respiratory access. The system may also include a powered air purifying respirator which positively pressures the interior space of the system.

The chemical protective poncho system may be used to encapsulate uncontaminated and decontaminated patients. In a chemical warfare environment, the chemical protective poncho system will be used to protect uncontaminated or decontaminated patients from chemical agent exposure while moving through a contaminated area. Additionally, the chemical protective poncho system will provide protection for uncontaminated or decontaminated patients awaiting evacuation or occupying cots/beds in treatment facilities when collective protection is not available. The chemical protective poncho system can enable all of these features and more while still allowing the patient to be mobile, by using their legs.

In one of more embodiments, the chemical protective poncho system is a lightweight, disposable, poncho like device. This item may be designed for use in protecting the uncontaminated or decontaminated patient from chemical warfare agents for a minimum of up to six hours. It may be fabricated of a permeable material impregnated with a chemical adsorbent material, for example.

In some various embodiments, the chemical protective poncho system may include a number of features such as: a zippered closure to access the patient and allow patient extraction from the inside or outside of the poncho; a transparent window for observation and communication with the patient; a quick deployable face shield is included to keep the ponchos hood and face shield off the patients face; an integrated cardholder for patient evacuation tag or field medical card; a port for intravenous tubing; a port for respiratory tubing; in some cases sleeves attached along each side with hand holes for litter poles or to serve as a field expedient litter without any additional components; in some implementations, arm sleeves for the patient to extend arms through; mounting provisions for attachment of powered air purifying respirator to provide positive pressure inside the wrap and eliminate the buildup of carbon dioxide inside the wrap; a skirt or liner to enclose the bottom of the poncho with a sealing member or elastic or drawstring. All of these features, among other components, may form part of the chemical protective poncho system.

The use of chemical protective poncho systems is not limited to warfighters and may be available to civilians, especially those living in areas at risk for chemical attacks or residing in locations near facilities which could release chemicals by accident. In these scenarios, a family may have need for chemical protective poncho systems. Additionally, the mobility of the chemical protective poncho system would allow families to engage the system and then relocate their family to a safe area for treatment or further evacuation.

DETAILED DESCRIPTION OF THE DISCLOSURE

Figure 1:
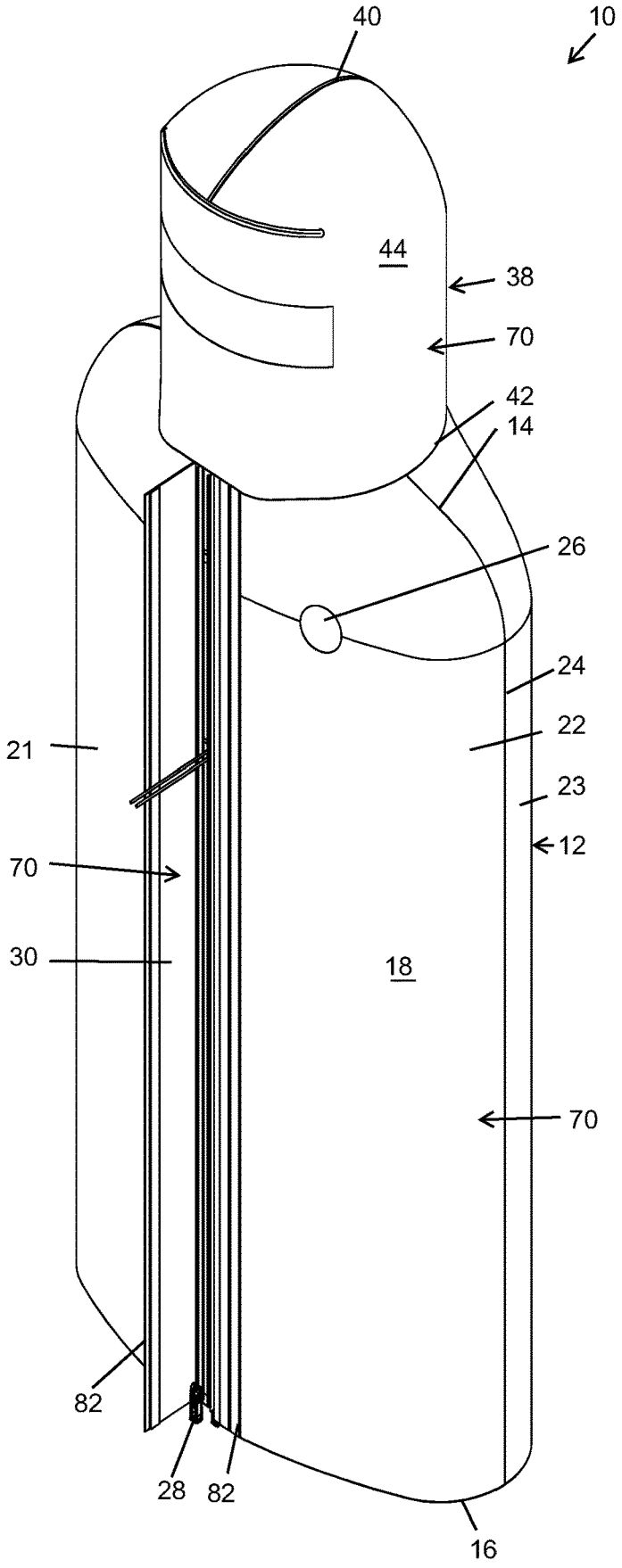
FIG. 1 shows a perspective view of a chemical protective poncho system, in accordance with one or more embodiments of the present disclosure.

In the following detailed description of the embodiments, reference is made to the accompanying drawings which form a part hereof, and in which is shown by way of illustration specific embodiments in which the disclosure may be practiced. The embodiments of the present disclosure described below are not intended to be exhaustive or to limit the disclosure to the precise forms in the following detailed description. Rather, the embodiments are chosen and described so that others skilled in the art may appreciate and understand the principles and practices of the present disclosure. It will be understood by those skilled in the art that various changes in form and details may be made without departing from the principles and scope of the invention. It is intended to cover various modifications and similar arrangements and procedures, and the scope of the appended claims therefore should be accorded the broadest interpretation so as to encompass all such modifications and similar arrangements and procedures. For instance, although aspects and features may be illustrated in or described with reference to certain figures or embodiments, it will be appreciated that features from one figure or embodiment may be combined with features of another figure or embodiment even though the combination is not explicitly shown or explicitly described as a combination. In the depicted embodiments, like reference numbers refer to like elements throughout the various drawings.

It should be understood that any advantages and/or improvements discussed herein may not be provided by various disclosed embodiments, or implementations thereof. The contemplated embodiments are not so limited and should not be interpreted as being restricted to embodiments which provide such advantages or improvements. Similarly, it should be understood that various embodiments may not address all or any objects of the disclosure or objects of the invention that may be described herein. The contemplated embodiments are not so limited and should not be interpreted as being restricted to embodiments which address such objects of the disclosure or invention.

Furthermore, although some disclosed embodiments may be described relative to specific materials, embodiments are not limited to the specific materials or apparatuses but only to their specific characteristics and capabilities and other materials and apparatuses can be substituted as is well understood by those skilled in the art in view of the present disclosure. Moreover, although the disclosed embodiments are primarily described in the context of military applications, the embodiments are not so limited. In is appreciated that the embodiments may be adapted for use in other applications which may be improved by the disclosed structures, arrangements and/or methods.

It is to be understood that the terms such as "left, right, top, bottom, front, back, side, height, length, width, upper, lower, interior, exterior, inner, outer, and the like as may be used herein, merely describe points of reference and do not limit the present invention to any particular orientation or configuration.

As used herein, the term "or" includes one or more of the associated listed items, such that "A or B" means "A but not B," and "B but not A." As used herein, the term "and" includes all combinations of one or more of the associated listed items, such that "A and B" means "A as well as B." The use of "and/or" includes all combinations of one or more of the associated listed items, such that "A and/or B" includes "A but not B," "B but not A," and "A as well as B," unless it is clearly indicated that only a single item, subgroup of items, or all items are present. The use of "etc." is defined as "et cetera" and indicates the inclusion of all other elements belonging to the same group of the preceding items, in any "and/or" combination(s).

As used herein, the singular forms "a," "an," and "the" are intended to include both the singular and plural forms, unless the language explicitly indicates otherwise. Indefinite articles like "a" and "an" introduce or refer to any modified term, both previously-introduced and not, while definite articles like "the" refer to a same previously-introduced term; as such, it is understood that "a" or "an" modify items that are permitted to be previously-introduced or new, while definite articles modify an item that is the same as immediately previously presented. It will be further understood that the terms "comprises," "comprising," "includes," and/or "including," when used herein, specify the presence of stated features, characteristics, steps, operations, elements, and/or components, but do not themselves preclude the presence or addition of one or more other features, characteristics, steps, operations, elements, components, and/or groups thereof.

It will be understood that when an element is referred to as being "connected," "coupled," "mated," "attached," "fixed," etc. to another element, it can be directly connected to the other element, or intervening elements may be present. In contrast, when an element is referred to as being "directly connected," "directly coupled," etc. to another element, there are no intervening elements present. Other words used to describe the relationship between elements should be interpreted in a like fashion (e.g., "between" versus "directly between," "adjacent" versus "directly adjacent," etc.). Similarly, a term such as "communicatively connected" includes all variations of information exchange and routing between two electronic devices, including intermediary devices, networks, etc., connected wirelessly or not.

It will be understood that, although the ordinal terms "first," "second," etc. may be used herein to describe various elements, these elements should not be limited to any order by these terms. These terms are used only to distinguish one element from another; where there are "second" or higher ordinals, there merely must be that many number of elements, without necessarily any difference or other relationship. For example, a first element could be termed a second element, and, similarly, a second element could be termed a first element, without departing from the scope of example embodiments or methods.

Similarly, the structures and operations discussed below may occur out of the order described and/or noted in the figures. For example, two operations and/or figures shown in succession may in fact be executed concurrently or may sometimes be executed in the reverse order, depending upon the functionality/acts involved. Similarly, individual operations within example methods described below may be executed repetitively, individually or sequentially, to provide looping or other series of operations aside from single operations described below. It should be presumed that any embodiment or method having features and functionality described below, in any workable combination, falls within the scope of example embodiments.

System:

A chemical protective poncho system for protecting a person from chemical exposure is presented. In one or more embodiments, a chemical protective poncho system includes a body extending a length between a top end and a bottom end, a hood attached near the top end, and a skirt or liner attached near the bottom end. In one or more embodiments, the chemical protective poncho system includes one or more layers of media (e.g., fabric or foam) impregnated with a chemical adsorbent material capable of filtering chemical agents while allowing oxygen and carbon dioxide to pass through the material. The disclosed embodiments may utilize various types of chemical adsorbent materials for filtering chemical agents including, for example, but not limited to: carbon, activated carbon, activated alumina, silica gel, molecular sieve carbon, molecular sieve zeolites and polymeric adsorbents and various combinations thereof. For ease of reference, a media impregnated with a chemical adsorbent material may be referred to herein as an adsorbent impregnated media.

In one or more embodiments, the chemical protective poncho is specially adapted to fit over the top of a patient and chemically seal the lower portion of the patient while allowing the patient ambulatory freedom. In some embodiments, the system may include one or more ports for intravenous access and/or respiratory access. In some embodiments, the system may include a powered air purifying respirator which positively pressures the interior space of the system.

With reference to the figures, for example, a chemical protective poncho system 10 for protecting a person from chemical exposure, or simply system 10 is presented. The system 10 may be used in association with a person, as a covering for a person, to protect a person from chemical exposure. The system 10 is used in association with a body 12 having a top 14, a bottom 16, an exterior surface 18, and an interior surface 20. The system 10 includes a hood 38 having a top 40, a bottom 42, an exterior surface 44 and an interior surface 46. In the arrangement shown, for example, the system 10 also includes a skirt 52 having a second end 54, a first end 56, an exterior surface 58, and an interior surface 60. In one or more embodiments, the system 10 may also be used in association with a powered air purifying respirator 78. The system 10 is also used in association with an adsorbent impregnated media 70.

The system 10 is used in association with all of these components, among other features, systems, and components as is described herein and shown in the figures.

Body:

In the arrangement shown, as one example, chemical protective poncho system 10 is used in association with a body 12. Body 12 may be formed of any suitable size, shape and design and is configured to be the main housing of a patient. In other words, body 12 is configured to serve as the main barrier between the filtered inside air and the non-filtered outside air. The body 12 functions as the bulk of the enclosure. Additionally, the function of the body 12 is configured to serve as a large filter layer allowing air to flow through the material of the body 12 while filtering chemical agents from the outside air.

In the arrangement shown, as one example, body 12 is generally sized and shaped to receive a human torso with sufficient room and space to accommodate different sizes and shapes of patients as well as to provide room for other clothing and equipment within the hollow interior of the body 12. In other words, body 12 extends from a top 14 to a bottom 16 in an elongated oblong tube-like shape. In the arrangement shown, as one example, the top 14 comes to a narrower opening. In other words, and with reference to the figures, the top 14 is shaped like the shoulder portion of the torso moving in toward the neck area. A hood 38 is attached to the generally centrally positioned opening in top 14. Hood 38 is further described herein.

In the arrangement shown, as one example, the bottom 16 is generally a circular opening with a skirt 52 attached to the bottom 16. Skirt 52 is further described herein. In the arrangement shown, as one example, bottom 16 is shaped in a generally eclipse like shape when viewed from a bottom elevation. Once again, the shape of bottom 16 is similar to a human torso at the waist.

In the arrangement shown, as one example, the fabric of bottom 16 is a surface layer which, by extending from the top 14 to the bottom 16 forms a hollow interior with an exterior surface 18 and an interior surface 20. In the arrangement shown, as one example, the body 12 is formed of a solid piece of fabric. However, the body 12 may be formed of multiple pieces. As an example, as is shown, the front half of body 12 is formed of an opposing first panel 21 and a second panel 22 and a third panel 23 that forms the back half of body 12. In the arrangement shown, as one example, opposing first panel 21 and a second panel 22 connect together at their middle at zipper 28. In the arrangement shown, as one example, the first panel 21 and the second panel 22 that form the front of body 12, connect at their rearward edges along a seamline 24 to the forward edges of a third panel 23 which forms the back of the body 12. In the arrangement shown, as one example, this seamline 24 extends from the top 14 to the bottom 16 along the forward-to-back center of body 12, however any other arrangement as well as any other number of panels 21,22, 23, are hereby contemplated for use in one or more implementations. Additionally, in this example, the upper portion of body 12, adjacent the top 14, is formed of multiple pieces of material attached to one another.

Seamlines: In the arrangement shown, as one example, these pieces are held together by one or more threads or stitching or welding or any other attachment means at seamlines 24. Seamlines 24 may be formed of any suitable size, shape and design and is configured to hold adjacent pieces together. In one arrangement, as is shown, seamline 24 is a stitch used to hold adjacent pieces together with a sealant activated by heat which creates a complete seal so air cannot pass into the interior of the body 12 through a seam. This sealant at seamlines 24 may be what is known as seam tape, however any other form of a sealant is hereby contemplated for use in one or more implementations, as is any other assembly method such as gluing, welding or the like or any combination thereof. In other words, due to the assembly methods and design used for the body 12 and the other components further described herein, air will only flow into the hollow interior of the body 12 by filtering through the adsorbent impregnated media 70, which makes up the fabric of the body 12, which is further described herein. That is, unfiltered air is prevented from passing through the seamlines 24. However, other methods of holding the pieces of the body 12 together or using a single, unitary piece are hereby contemplated for use in one or more implementations. These other methods of design and assembly include using a single, unitary piece for the body 12, hood 38, and skirt 52.

Port: In the arrangement shown, as one example, body 12 includes a port 26. Port 26 is formed of any suitable size, shape and design and is configured to provide an opening or inlet for which an air tube/respiratory tube 80 of a powered air purifying respirator (PAPR) 78 can be inserted and/or attached. In one arrangement, port 26 is configured to allow a respiratory tubing 80 to extend, uninterrupted, from the exterior of the body 12 and into the interior of the body 12. In another arrangement, respiratory tube 80 attaches directly to port 26. In the arrangement shown, as one example, port 26 is generally circular and located nearer the top 14 of the body 12. However, any other shape, size, or location for port 26 is hereby contemplated for use in one or more implementations.

By using and shaping port 26 in this way, port 26 allows for a passageway of air to be forced into the interior of system 10. Thus, a positive air pressure with filtered air is created within system 10. In the arrangement shown, as one example, the port 26 is used in association with a respiratory tubing 80, which is further described herein, as well as with a powered air purifying respirator 78 which is further described herein. These components operate in sync to create a positive air pressure which facilitates in the operation of port 26.

In the arrangement shown, as one example, port 26 is an opening. The opening is configured to create a close and tight seal around respiratory tubing 80. As a back-up to this seal and design, the positive air pressure of the interior of the body 12 will exit through any gaps, forcing air outwards, between the respiratory tubing 80 and the inner seam of port 26. In this arrangement, as one example, a redundancy is created such that no air leaks to the interior of system 10 without first being filtered. This arrangement is advantageous because it ensures the safety of the patient by ensuring that chemical agents or other harmful toxins cannot enter the interior of system 10.

It is also contemplated that additional ports 26 may be present in either the body 12 or the hood 38. These ports 26 may be formed of any suitable size, shape and design and are configured to facilitate any other purpose such as the entry and/or exit of air tube/respiratory tube 80 of a powered air purifying respirator (PAPR) 78 as describe above, or tubing to reach the patient, such as tubing for an intravenous (IV) injection, tubing to get water to the patient, tubing to get medicine to the patient or for any other purpose as is further described herein.

Zipper: In the arrangement shown, as one example, body 12 is used in association with a zipper 28. Zipper 28 is formed of any suitable size, shape and design and is configured to open and close the front portion of body 12 so that a patient can enter and/or exit the interior of system 10. In the arrangement shown, as one example, zipper 28 extends from the top 14 of body 12 to the bottom 16 of body 12. In the arrangement shown, as one example, zipper 28 is located in the center of the front and is oriented vertically along body 12.

In the arrangement shown, as one example, zipper 28 is a common zipper also known as a clasp locker. Clasp lockers are commonly used for binding the edges of an opening of fabric to other flexible material, such as on a garment or a bag. In the arrangement shown, as one example, the zipper 28 is formed of two rows of protruding teeth, which are made to interdigitate, linking the rows and thus linking the first panel 21 and second panel 22 of fabric they are attached to.

In the arrangement shown, as one example, zipper 28 is formed of a left portion and a right portion that connects to one another when in a zipped state and disconnect from one another in an un-zipped state. In the arrangement shown, as one example, the left portion of zipper 28 is connected by a seamline 24 to the interior forward edge of the first panel 21 and the right portion of zipper 28 is connected by a seamline 24 to the interior forward edge of the second panel 22. In this way, zipper 28 connects and disconnects the first panel 21 and second panel 22 of the front portion of body 12 at approximately the middle of body 12 thereby providing quick and easy access for a patient into the hollow interior of body 12.

One of the benefits of using a conventional off the shelf zipper as zipper 28 is that conventional off the shelf zippers are inexpensive as well as widely available. One of the disadvantages of using a conventional zipper as zipper 28 is that chemical contaminants can easily pass through the porous components of zipper 28.

While a zipper 28 is used in the example as shown, other fasteners are hereby contemplated for use, such as, but not limited to, hook and loop fastener, magnetic fastening, buttoning, tying, clipping, adhesions, gluing, affixing, and any other manner of interlocking or connecting two pieces of fabric, and the like.

Exterior Flap: In the arrangement shown, as one example, body 12 is used in association with an exterior flap 30. Exterior flap 30 is formed of any suitable size, shape and design and is configured to form a complete enclosure of the body 12 after the patient has been zipped into the hollow interior. In the arrangement shown, as one example, exterior flap 30 extends the length of the body 12 from the top 14 of the body 12 to the bottom 16 of the body 12. In the arrangement shown, as one example, exterior flap 30 coincides with zipper 28 so as to be a length which is just slightly longer than zipper 28 so that exterior flap 30 can completely cover zipper 28. That is, exterior flap 30 overlaps the exterior surface of zipper 28 and extends past the outward edges of zipper 28 by a distance thereby preventing any contaminated air from passing through zipper 28. Instead, exterior flap 30 filters contaminants out of air that passes through zipper 28.

In the arrangement shown, as one example, exterior flap 30 is attached and sealed along one side running vertically, adjacent to zipper 28 by a seamline 24. The opposite side of exterior flap 30 contains a fastener 82 such as a hook and loop fastener on the side of the exterior flap 30 which is opposite the seamline 24. In the arrangement shown, as one example, wherein when fastener 82 is a hook and loop fastener, an opposing portion of hook and loop strip is attached to body 12 and is configured to receive the portion of hook and loop strips connected to exterior flap 30. Any other form of a fastener is hereby contemplated for use for fastener 82 such as buttons, clips, zippers, draw strings, ties, or any other fastening member, method or means or any combination thereof. In this way, the exterior flap 30 can fold over (and enclose) the zipper 28 when the fastener 82 engage is engaged thereby holding flap 30 shut or closed. Thus, the exterior flap 30 attaches on both sides of the zipper 28. This is an advantageous feature because the exterior flap 30 is made of a material that blocks or filters contaminants, such as being made of the same material as body 12. In the arrangement shown, as one example, exterior flap 30 is made of a single piece of adsorbent impregnated media 70 such that air cannot leak through the zipper 28 without first passing through the layer of the exterior flap 30. Thus, any air passing through the zipper 28 has already been filtered by the exterior flap 30.

Interior Flap: In one or more embodiments, as an added layer of protection at the zipper 28, body 12 may include an interior flap 32. Interior flap 32 is formed of any suitable size, shape and design. Interior flap 32 is configured as a protective filter layer on the interior side of the zipper 28. In one arrangement interior flap 32 is formed of the same shape and design of exterior flap 30, but in the arrangement shown, is placed on the interior side of the zipper 28 instead of being located on the exterior side of zipper 28. As such, the teaching presented herein with respect to the exterior flap 30 is applied equally to interior flap 32.

In this way, interior flap 32 is accessible to the patient from the inside of body 12. This added layer of material provides additional filtering and ensures no contaminated air will enter the interior of the system 10. Additionally, a patient has access to the interior flap 32. In this way, a patient can secure the interior flap 32 in the event there is not enough time to secure the exterior flap 30, or similarly, in the event the exterior flap 30 becomes unsealed by an accident. In this way, the patient would not have to stop a fellow war-fighter to reseal the exterior flap 30. Or in the alternative, the patient would not have to unzip the zipper 28 to access the exterior flap 30, thus risking exposure to harmful chemical agents. In the arrangement shown, as one example, interior flap 32 is formed of the same material as exterior flap 30. In other words, interior flap 32 is formed of an adsorbent impregnated media 70. Similarly, in the arrangement shown, as one example, interior flap 32 is threadably connected to body 12 and uses a fastener 82, such as a hook and loop fastener or any other form of a fastener for engaging with body 12. As such, the use of interior flap 32 along with exterior flap 30 may provide an added level of safety and security and durability to the system 10. Also, the use of interior flap 32 along with exterior flap 30 that is formed of an adsorbent impregnated media 70 that is breathable and filters contaminants and/or is formed of a material that is impermeable to contaminants, provides far greater protection for the patient than just using a single interior flap 32 or a single exterior flap 30. As such, the use of dual flaps 30, 32 is a substantial security and safety feature.

Figure 5:
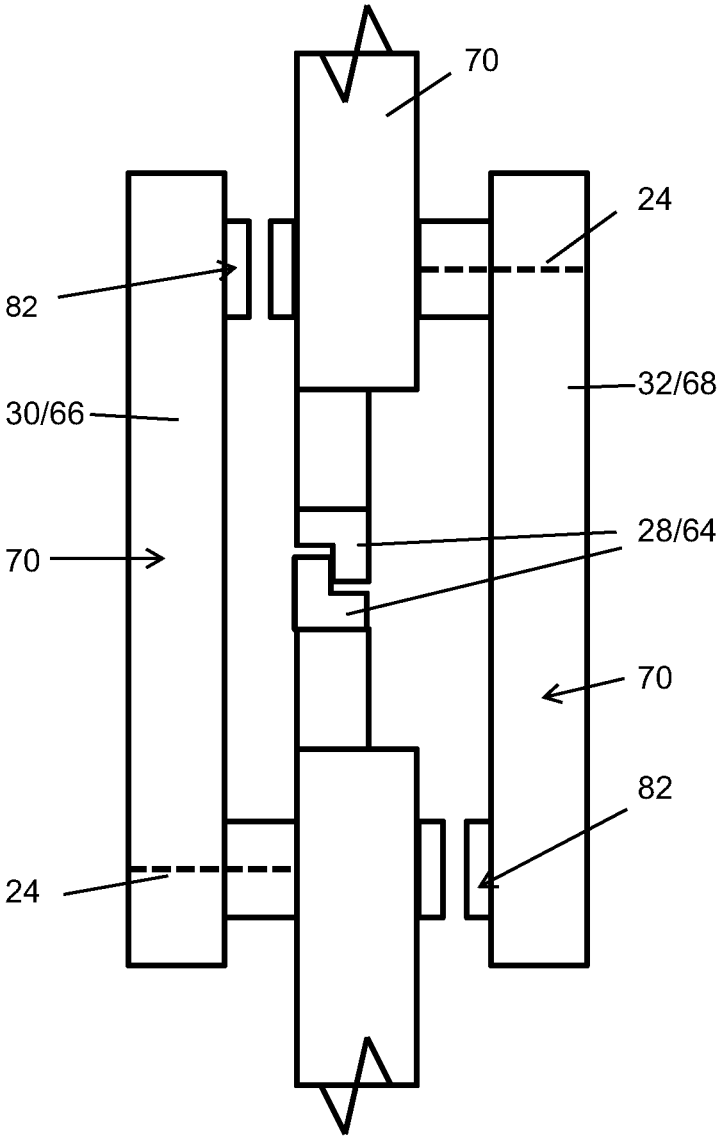
FIG. 5 shows a cross section of a zipper connecting first and second ends of fabric with an interior flap and an exterior flap covering the zipper, in accordance with one or more embodiments of the present disclosure.
Figure 6:
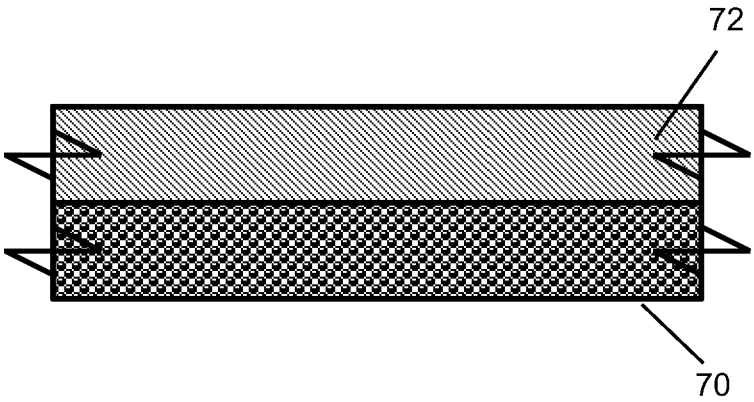
FIG. 6 shows a cross section of a laminate of an adsorbent impregnated media layer with another layer of material, in accordance with one or more embodiments of the present disclosure.
Figure 7:
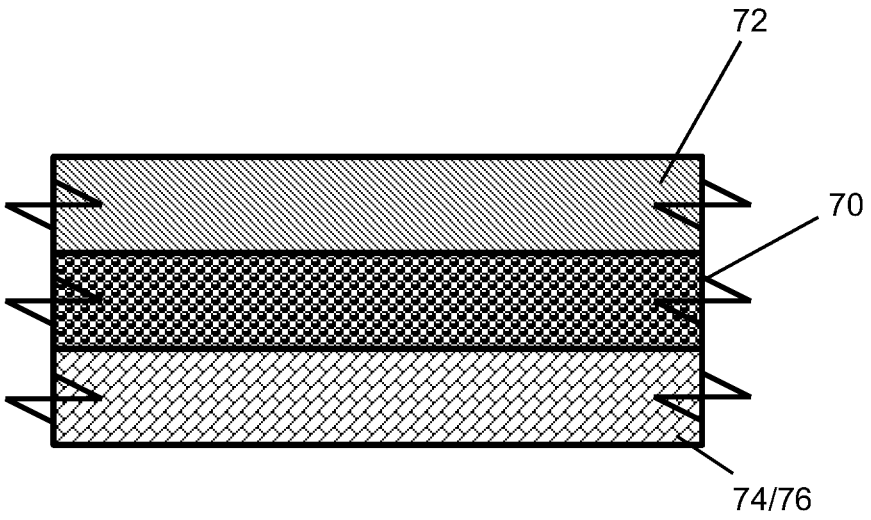
FIG. 7 shows a cross section of a laminate of an adsorbent impregnated media layer with two other layers of material, in accordance with one or more embodiments of the present disclosure.
Figure 8:
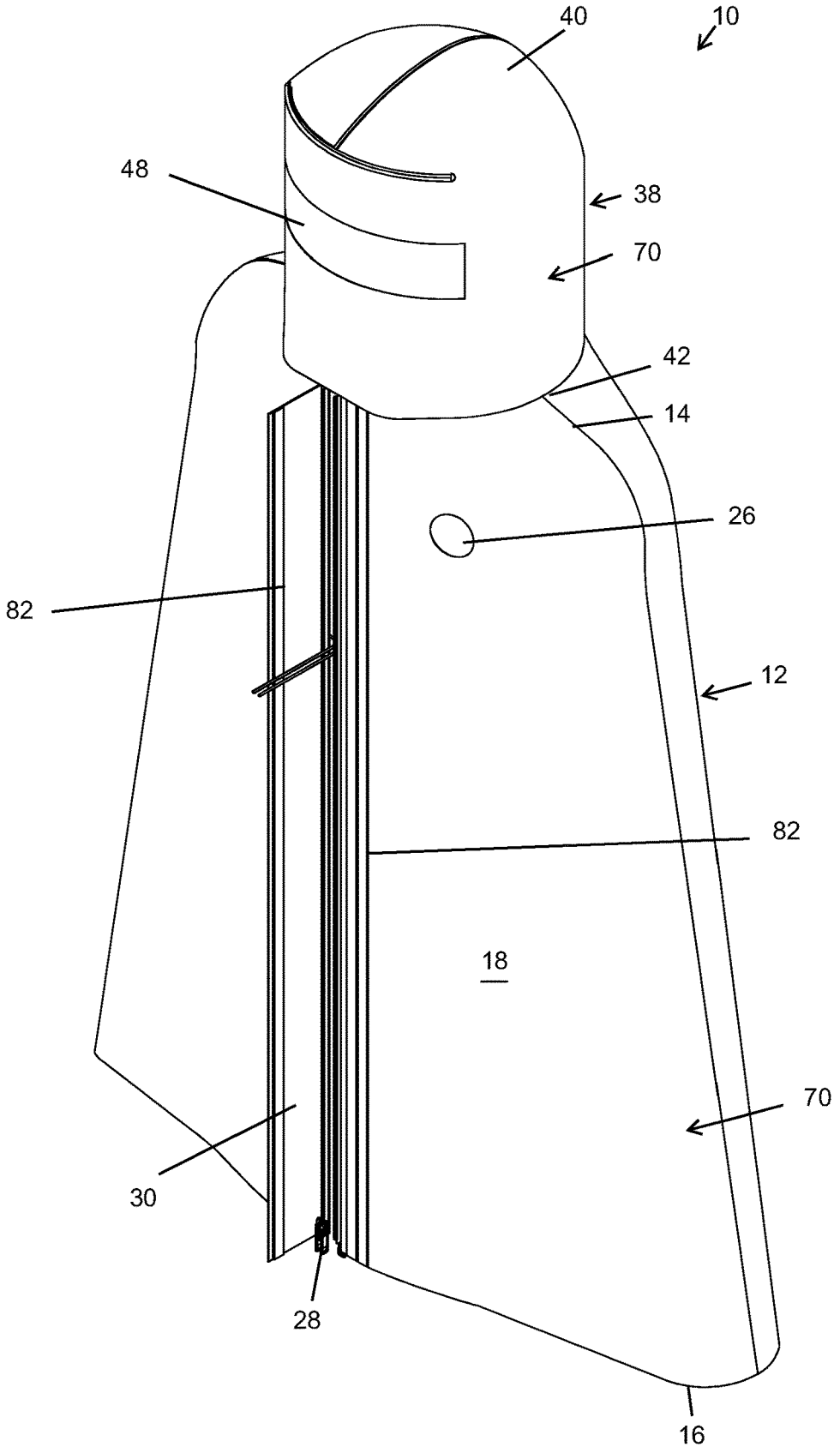
FIG. 8 shows a perspective view of a chemical protective poncho system, in accordance with one or more embodiments of the present disclosure.

In the arrangement shown, as one example, to facilitate easy use, as is shown, in FIG. 5, the interior flap 32 and exterior flap 30 are offset to one another. That is, interior flap 32 is attached by a seamline 24 to one of the first panel 21 or second panel 22, and the exterior flap 30 is attached by a seamline 24 to the other of the first panel 21 or second panel 22. This arrangement provides increased strength to the system, makes it easier to get in and out of the chemical protective poncho system 10, and provides better overlap that provides better contaminant blocking. However the other arrangement is also hereby contemplated for use wherein both the interior flap 32 and exterior flap 30 are attached on the same panel first panel 21 or second panel 22 by seamline 24 which also provides its own advantages.

Figure 2:
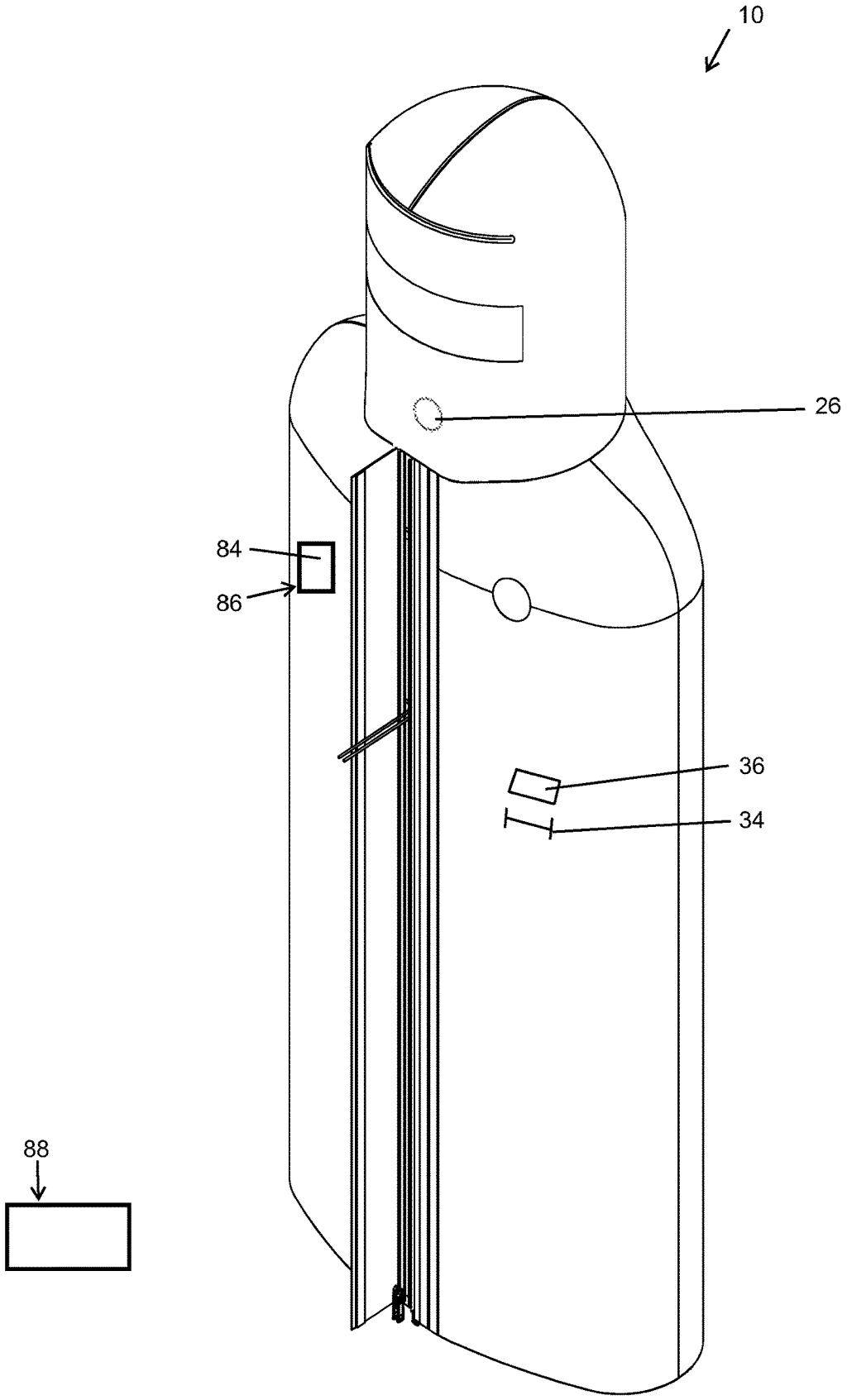
FIG. 2 shows a perspective view of another chemical protective poncho system, in accordance with one or more embodiments of the present disclosure.
Figure 3:
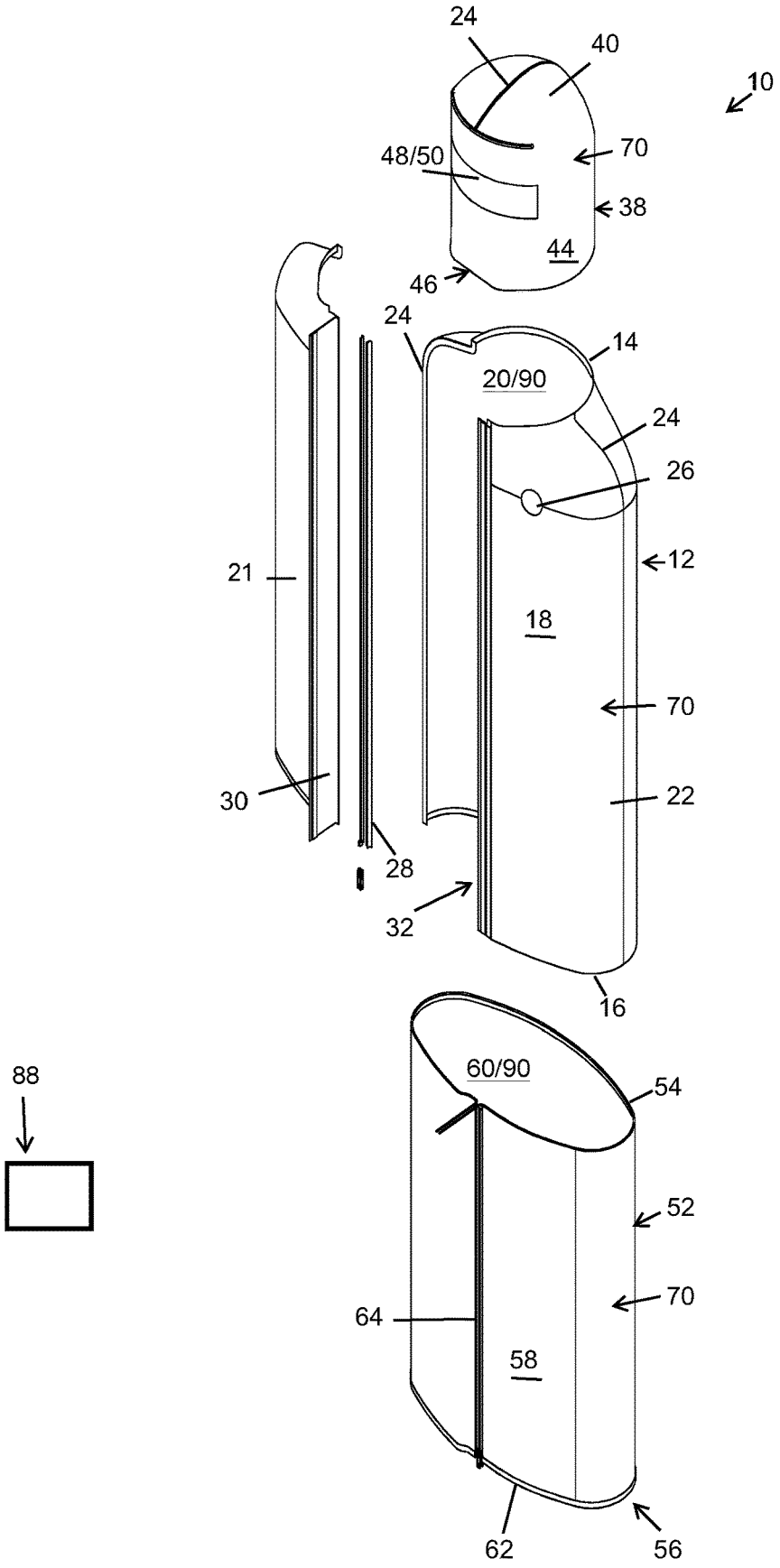
FIG. 3 shows an exploded perspective view of a chemical protective poncho system, in accordance with one or more embodiments of the present disclosure.
Figure 4:
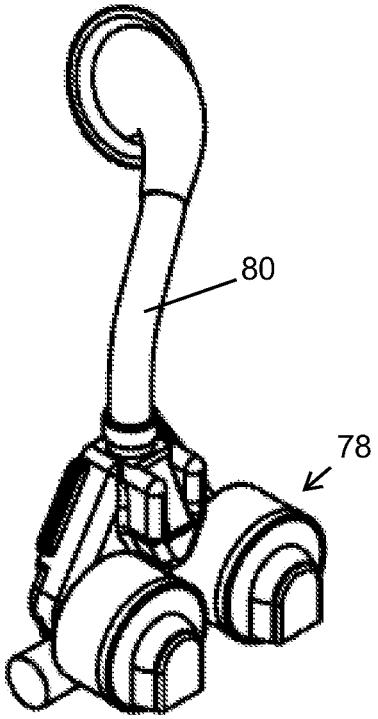
FIG. 4 shows a perspective view of a powered air purifying respirator, in accordance with one or more embodiments of the present disclosure.

Intravenous Port: In the arrangement shown in FIG. 2, as one example, body 12 is used in association with an intravenous port 34. Intravenous port 34 is formed of any suitable size, shape and design and is configured to provide a small, sealed opening for a needle, an intravenous tube or other small medical tubes or devices to enter the interior of system 10 from the exterior of system 10. In the arrangement shown, as one example, intravenous port 34 is formed and shaped as a small slit or slender opening in the body 12. In the arrangement shown, as one example, intravenous port 34 is shown on the front side of the body 12 nearer the lower to middle of the body 12.

In the arrangement shown, as one example, intravenous port 34 is formed of a tight opening and is only a slit, or slender cut in the material such that the material naturally closes tightly around any tubes passing through the intravenous port 34. However, other formations of an intravenous port 34 are hereby contemplated for use in one or more implementations. As an example of another arrangement of an intravenous port 34, an intravenous port 34 may be formed from a slit with hook and loop fastener system such that the opening of the intravenous port 34 can be sealed efficiently around tubing. Another arrangement may be a small slit housing an adhesive, a magnet, or other closing means. Any other form of a sealing means is hereby contemplated for use around intravenous port 34 in one or more implementations.

In the arrangement shown, as one example, the intravenous port 34 is a small opening with close and tight tolerances so as to form an air seal around any tubes in the port 34. Additionally, a flap 36 may be used to cover the intravenous port 34 when not in use. In this arrangement, as one example, flap 36 is threadably attached at the top and allowed to hang over the intravenous port 34 and any tubing that may be moving through the intravenous port 34. In this way, the flap serves to add protection to block and/or filter air. In the arrangement shown, as one example, flap 36 is formed of the adsorbent impregnated media 70 as that of the body 12, however any other material is hereby contemplated for use such as an impermeable material. A flap 36 may be located on an upper side of both the intravenous port 34 and the port 26 and any other port or opening in the system 10 as this is advantageous as harmful chemical agents are heavier than the air and will tend to float downward. In other words, flap would catch any floating harmful agents before they have a chance to enter an opening at the port 26 or an opening at the intravenous port 34. In one or more embodiments, the system may include a loop or strap (not shown) above the intravenous port to facilitate hanging of one or more intravenous fluids.

Arms: In various arrangements, as examples, the body 12 of system 10 may additionally include a pair of arms (or sleeves). The pair of arms are formed of any suitable size, shape, and design and are configured to provide space for a patient's arms to extend outside the body. In various arrangements, as examples, the arms are attached to the body 12 through any means of connection and extend outward from the body.

Hood:

In the arrangement shown, chemical protective poncho system 10 is used in association with a hood 38. Hood 38 may be formed of any suitable size, shape and design and is configured to enclose the upper portion of system 10. In this arrangement, as is shown in one example, hood 38 is configured to encapsulate the head of the patient housed within system 10.

In the arrangement shown, as one example, hood 38 is generally cylindrical in shape extending from a bottom 42, where the hood 38 is attached to the top 14 of body 12, to a top 40. In the arrangement shown, as one example, the top 40 of hood 38 is shaped in a generally semi-circular, or semi-spherical, manner so as to house the top of a human head. In the arrangement shown, as one example, hood 38 has an exterior surface 44 and an interior surface 46. Hood 38 is sized and shaped to house a human head. In the arrangement shown, as one example, hood 38 is oversized so as to accommodate even the largest of patients as well as a helmet, a hat, other head gear or even bandages around the patient's head. While the arrangement shown is for one patient, a hood 38 configured to house multiple patients is hereby contemplated for use in one or more implementations.

In the arrangement shown, the hood 38 is positioned at the top 14 of the body 12. Similar to the body 12 being shaped like a human torso, the hood 38 is shaped to cover a human head. For this reason, the hood 38, being attached to the top 14 of the body 12 has the appearance of the upper portion, or hood, of a common hazmat suit. In the arrangement shown, as one example, the hood 38 is made from the adsorbent impregnated media 70. This layer of adsorbent impregnated media 70 allows clean air to filter into the hood 38. This arrangement is advantageous because the permeable hood 38 allows the patient to breathe through the hood 38.

Another benefit of hood 38 being permeable or breathable is that the amount of air penetrating the hood 38 is important to reduce claustrophobia among patients. While many war fighters are highly trained, physically extreme circumstances may exist for the patient. For example, if a patient has a severe wound, then air intake and heartrate will be increased. Thus, more air flow through the material of system 10 is needed to compensate for extra oxygen turnover into carbon dioxide. In the arrangement shown, as one example, hood 38 is configured to maximize the surface area of the impregnated carbon fabric 70.

In the arrangement shown, as one example, hood 38 is used in association with a face shield 48. Face shield 48 is formed of any suitable size, shape, and design and is configured to provide direct visual access to the patient. Additionally, the face shield 48 is configured to provide direct visual access to the outside environment for the patient. In the arrangement shown, as one example, face shield 48 is formed of a transparent, impermeable, flexible plastic material, however any other material is hereby contemplated for use in one or more implementations.

In the arrangement shown, as one example, face shield 48 is a generally elongated, flat rectangle providing a small or narrow access window. Face shield 48 is configured to be at eye level of the patient while the patient is housed inside system 10. In the arrangement shown, as one example, face shield 48 is configured in an elongated rectangle which runs horizontally along the front of the hood 38. This elongated rectangle arrangement, as one example, provides the patient with a wider viewing angle. In this way, the patient will be able to look further left and right, which may be advantageous in a field of battle. Additionally, this slender arrangement allows for the adsorbent impregnated media 70 to be over the patient's mouth which increases the amount of filtered air entering at the location of the patient's mouth, or air intake system. Any other size, shape or design or placement is hereby contemplated for use for face shield 48 in one or more implementations.

In the arrangement shown, as one example, hood 38 is all encompassing and is attached to the top 14 of the body 12 around the entire perimeter of the bottom 42 of the hood 38 by a seamline 24. That is, in the arrangement shown, as one example, the hood 38 is attached to the top 14 of body 12 using a thread which connects hood 38 and body 12 at a seam. However, other arrangements of the hood 38 are hereby contemplated for use, in one or more implementations. Because chemical agents are heavier than air and they tend to fall to the ground as they are pulled by gravity, a hood with an opening or other arrangements may be used. Additionally, larger face shields 48 may be used, especially in an arrangement where a powered air purifying respirator 78 is deployed. In another arrangement, as one example, a deployable face shield 50 may be used. A deployable face shield 50 is configured to keep the front of the hood 38 off the patient's face. In this arrangement, a deployable face shield 50 would enable easier breathing for the patient as well as maintain the position of the face shield 48 such that the patient has a more clear and consistent view of the outside environment. These and other arrangements of a hood 38 are hereby contemplated for us, in one or more implementations.

Skirt:

In the arrangement shown, chemical protective poncho system 10 is used in association with a skirt 52. Skirt 52 may be formed of any suitable size, shape and design and is configured to enclose the lower end of system 10 while still allowing the patient to be mobile.

In the arrangement shown, as one example, skirt 52 is shaped in a generally oblong cylinder matching the shape of the body 12. In the arrangement shown, as one example, skirt 52 extends from a second end 54 to a first end 56. In the arrangement shown, as one example, skirt 52 has an exterior surface 58 and an interior surface 60. In the arrangement shown, as one example, skirt 52 is attached and sealed to the body 12 at, and along the perimeter of second end 54. In various arrangements, as examples, the skirt 52 is attached to body 12 using a thread which connects skirt 52 and body 12 at a seam.

In the arrangement shown, as one example, skirt 52 includes a sealing member 62 (or alternatively, a trouser belt). Sealing member 62 is formed of any suitable size, shape and design and is configured to provide a means for a patient or assisting war fighter to enclose the lower portion of patient within system 10. In the arrangement shown, as one example, sealing member 62 is formed of a draw string sewn into a hem or casing (a continuous tube of material) along the perimeter of the skirt 52 nearer the first end 56.

In the arrangement shown, as one example, sealing member 62 is loose when it is not being used and tightened when needed. In this arrangement, sealing member 62 has two ends of the string exposed out of two ends of the perimeter of the hem. These two ends of sealing member 62 may be tied together, and tightened, to hold the first end 56 of the skirt 52 in place around the waist of the patient thereby sealing the lower end of the system 10 against the chemical protective pants or trousers worn by the patient thereby preventing contaminants from entering the hollow interior of the system. In an alternative arrangement, the sealing member 62 may be designed to tie into the waist of military issue clothing designed to protect against chemical agents. For example, a war fighter may be wearing pants impermeable to chemical agents. By attaching the first end 56 of the skirt 52 to the waist of these pants, the patient creates an entire encapsulation of system 10 which keeps all skin and other body parts from getting exposed to harmful chemical agents.

In the arrangement shown, as one example, a sealing member 62 is used to enclose the first end 56 of skirt 52. However, any other means or methods of enclosing the first end 56 of skirt 52 are hereby contemplated for use in one or more implementations. Other means or methods, as an example, may include elastic, magnetic attachment, hook and loop fastener attachment, or the like or any combination thereof.

In the arrangement shown, as one example, skirt 52 is made from an impermeable material or an impenetrable material. In the arrangement shown, as one example, skirt 52 is covered from above by the body 12 of system 10. That is, when system 10 is worn by a patient, the skirt 52 extends upward from its connection point at second end 54 at the bottom 16 of body 12 to the first end 56, which is sealed against the patient's body. In one arrangement, the bottom 16 of body 12 extends below the patient's waist, whereas that first end 56 of skirt 52 is positioned around the patient's waist and is tightened or sealed thereto.

In the arrangement shown, as one example, the body 12 and the hood 38 both act as filtering material. The surface area of these two components is enough to facilitate in adequate air turnover to support life of the patient. Thus it is advantageous to use an impermeable or impenetrable material for the skirt 52 as it may be less expensive, easier to use, easier to wear, allow greater movement, among other advantages. In this way, a more efficient and cost-saving device can be created. In the arrangement shown, as one example, skirt 52 is formed of a polyethylene coated and laminated cloth. However, any other material of skirt 52 is hereby contemplated for use, including but not limited to, a skirt 52 made from a adsorbent impregnated media 70 as is described herein so as to provide increased air flow through the skirt 52.

In the arrangement shown, as one example, skirt 52 is used in association with a zipper 64. Zipper 64 is formed of any suitable size, shape and design and is configured to open and close the skirt 52 so as to allow a patient to quickly and easily get in and out of system 10. In the arrangement shown, as one example, zipper 64 is formed of a similar size, shape, and design of the zipper 28 associated with the body 12, and therefore the teaching presented with respect to zipper 28 in body 12 is reiterated herein for zipper 64 of skirt 52. In the arrangement shown, as one example, however, zipper 64 for the skirt 52 is sized according to the skirt 52. In an alternative arrangement, a zipper 64 (as well as zipper 28) may not be needed. In this alternative arrangement, either a unitary system 10 is slid over the patients head, or the zipper 28 of the body 12 is sized large enough to allow the patient to fit in the opening created by zipper 28 of the body 12 and the patient steps through the opening in the upper end of skirt 52.

In the arrangement shown, as one example, skirt 52 is also used in association with an exterior flap 66 and an interior flap 68. Exterior flap 66 and interior flap 68 are used in association with the zipper 64 of the skirt 52 in a similar manner to that described with respect to the exterior flap 30 and the interior flap 32 used in association with the zipper 28 of the body 12. All of that teaching presented with respect to exterior flap 30 and the interior flap 32 used in association with the zipper 28 of the body 12 is repeated for the zipper 64, exterior flap 66 and interior flap 68.

Powered Air Purifying Respirator:

In the arrangement shown, chemical protective poncho system 10 may be used in association with a powered air purifying respirator 78, which is also known as a PAPR. Powered air purifying respirator 78 may be formed of any suitable size, shape and design and is configured to supply clean air to the interior space of system 10.

A powered air purifying respirator 78 is a type of personal protective equipment used in situations to protect a human from breathing in contaminated air. Powered air purifying respirators 78 may consist of a respirator adapted for use to mount on system 10. Powered air purifying respirators 78 take in ambient air that is contaminated with one or more pollutant or pathogen, actively remove (filter) a sufficient portion of these hazards from the air, and then deliver the clean air to the user.

Powered air purifying respirators 78 are well known in the art and are used in a variety of applications. In this case, an appropriately sized powered air purifying respirator 78 is selected. In the arrangement shown, a powered air purifying respirator 78 may be attached directly to the body 12 of system 10, or the powered air purifying respirator 78 may be in a sling which wraps over the should of the patient. In another alternative arrangement, as another example, a powered air purifying respirator 78 may be a mask attached to the patients face, located on the interior of the system 10. A powered air purifying respirator 78 must be conveniently sized and shaped to be portable but must be large enough to have the power needed to supply the interior of system 10 with adequate clean air.

In the arrangement shown, as one example, powered air purifying respirator 78 is attached to the front of the body 12. Powered air purifying respirator 78 is connected the respiratory tubing 80 which is connected to the port 26. In the arrangement shown, as one example, the powered air purifying respirator 78 cleans and/or filters the outside air before forcing the air through the respiratory tubing 80 and into the port 26 where the clean air is expelled into the interior space of system 10.

In an alternative arrangement, respiratory tubing 80 is not required. In this arrangement, as one example of a configuration of a powered air purifying respirator 78, the powered air purifying respirator 78 attaches directly to the port 26, thus expelling clean and/or filtered air directly into the interior space of the body 12.

Adsorbent Impregnated Media:

In the arrangement shown, chemical protective poncho system 10 is used in association with an adsorbent impregnated media 70. Adsorbent impregnated media 70 may be formed of any suitable size, shape and design and is configured to be selectively permeable in that adsorbent impregnated media 70 allows air to pass through the material while it filters chemical agents from the air entering the interior of system 10. The adsorbent impregnated media may include any suitable chemical adsorbent material configured and arranged to filter one or more chemical agents of concern. Depending on the chemical agents to be filtered, chemical adsorbent material utilized in different implementations ray include, for example, carbon, activated carbon, activated alumina, silica gel, molecular sieve carbon, molecular sieve zeolites and polymeric adsorbents and/or various combinations thereof. Additionally or alternatively, in one or more embodiments, the fabric may include one or more materials configured to filter microbial contaminants.

In the arrangement shown, as one example, adsorbent impregnated media 70 is formed of a tricot knit nylon cloth laminated to polyurethane foam and impregnated with an activated carbon mixture. However, the embodiments are not so limited. Rather, chemical adsorbent material may be impregnated into any suitable type of media, which may include but is not limited to various types of fabric (e.g., woven, knitted, felted and/or non-woven fabrics) and/or non-fabric material foam). Furthermore, in various implementations, the media may be formed from various organic and/or synthetic materials known in the art. In the arrangement shown, as one example, body 12 and hood 38 are formed almost exclusively of adsorbent impregnated media 70. In the arrangement shown, as one example, the skirt 52 need not be an adsorbent impregnated media 70. However, in one or more embodiments, the skirt 52 may be formed from an adsorbent impregnated media 70. Additionally or alternatively, other smaller additional covering components, such as a small covering for the port 26 and/or the intravenous port 34, interior flap 32,60, exterior flap 30, 58 or any other suitable component or part may be formed of an adsorbent impregnated media 70.

In the arrangement shown, as one example, adsorbent impregnated media 70 is formed of multiple layers that work in concert with one another to filter chemical agents from the air entering the interior of the system 10. In the arrangement shown, as one example, adsorbent impregnated media 70 includes at least one layer of chemical adsorbent material, which acts as the main filter for chemical agents. In one arrangement the at least one layer of chemical adsorbent material is a layer of activated carbon powder, dust, granules, pellets or any other form of carbon and/or activated carbon.

In the arrangement shown, as one example, all seams (whether threaded or not) are hermetically seam-sealed using a seam seal for protection against chemical agents. This prevents air from passing into the hollow interior of the system 10 along the holes formed by stitching. However, other means of sealing seams are hereby contemplated for use in one or more implementations.

In the arrangement shown, as one example, two layers are used to create the adsorbent impregnated media 70. In the arrangement shown, as one example, a carbon impregnated cloth layer and a durable water resistant layer 72. The durable water resistant layer 72 lays across the top of the carbon impregnated layer of the adsorbent impregnated media 70 so as to keep water and other moisture from penetrating the carbon activated layer and thereby affecting the carbon-layer's ability to filter out contaminants. If water were to penetrate the carbon activated layer, the activated carbon would diminish in effective filtering. Water resistant layer 72 may be a separate layer of fabric placed over the adsorbent impregnated media 70 in places or over the whole system 10. Alternatively, water resistance layer 72 may be a sprayed-on layer or coating that is placed over some or all of system 10.

In the arrangement shown, as one example, adsorbent impregnated media 70 is also used in association with an inner layer 90. Inner layer 90 is formed of any suitable size, shape and design and is configured to provide comfort for the patient. In the arrangement shown, as one example, inner layer 90 lines at least a portion of, if not the entirety of, the interior surface 20 of the body 12. In the arrangement shown, as one example, inner layer 90 lines at least a portion of the interior surface 46 of the hood 38. Additionally, inner layer 90 may line at least a portion of the interior surface 60 of skirt 52. In some arrangements, the adsorbent impregnated media 70 is not comfortable to touch, so the inner layer 90 provides a comfortable surface for the patient.

However, an alternative number of layers or filtering materials are completed for use as an adsorbent impregnated media 70 and for fabric, in general, in use with system 10. As an example, layers of fabric which are biological contaminant filtering may be desired. In the arrangement shown, as one example, a HEPA (high efficiency particulate air) layer 74 is used for filtering harmful biological agents is added. As another example, a radiological resistant/filter 76 may be desired. In an alternative embodiment, a plurality of layers can be added to the fabric such that the fabric filters chemical, biological and nuclear contaminants.

In one arrangement, portions of impermeable material may be used with the system to help reduce the effect of water, such as rain, on the system. These portions of impermeable material may be placed where chemical interaction is going to be the most prominent, which may be the top of the shoulders of body 12 as well as the top of hood 38.

In Operation:

In the arrangement shown, the body 12 is connected to the hood 38 and the skirt 52 and is sealed within an impervious wrap 88 which protects the chemical protective poncho system 10 for years prior to use. Upon removing the chemical protective poncho system 10 from an impervious wrap 88, such as a sealed bag, system 10 is wrapped around a patient with the zipper 28 and the face shield 48 facing forward, such that, the patient is able to visually see through face shield 48. Once the patient is positioned within the interior of system 10, system 10 must be enclosed.

First, the skirt 52 should be attached to the patient's waist by the tightening and tying the sealing member 62 around the patient. In the alternative, the sealing member 62 may be configured to engage military issue chemical protective pants. In this case, the sealing member 62 should be attached to the pants as designed. This seal between skirt 52 and the patient's protective pants or trousers encloses the lower portion of system 10. The zipper 64 of skirt 52 is zipped and the interior flap 68 and exterior flap 66 are sealed around the zipped zipper 64 thereby sealing the zipper 64.

The rest of system 10 is enclosed by zipping the zipper 28 of the body 12 followed by the interior flap 32 and exterior flap 30. The patient can fold the interior flap 32 over the zipper 28 on the interior to create a complete filter surface overlapping the seam of the zipper 28. Additionally the exterior flap 30 can be folded over the exterior of the zipper 28 to create a complete filtering surface.

Optionally, a powered air purifying respirator 78 may be used if it is determined that additional air should be delivered to the interior of the system 10. If the powered air purifying respirator 78 is not already attached to the port 26, then it should be attached to the port 26 and then powered on. This will deliver clean air to the interior of the system 10. The patient's legs are exposed, and free to move about, through the bottom of system 10. The patient is able to see through the face shield 48 of the hood 38. In this arrangement, as is shown, a patient will be able to move to a treatment area and/or an evacuation point. Additionally, a patient may be housed in one location, such as a treatment facility, without losing mobility.

As an additional component, and in an alternative embodiment, a patient evacuation tag 86 may be used to identify and/or diagnose the patient. This patient evacuation tag 86 would be placed within a transparent pocket 84, or integrated cardholder, located on the exterior surface 18 of the body 12. The tag would assist various personnel in communicating with the patient, clearly understanding diagnosis of the patient without opening the system 10, as well as other information such as patient name, and more.

In operation, this system 10 is portable and is not limited to war fighters. Civilians or others which are in fear or subject to an environment susceptible to chemical warfare or chemical agents can activate the portable system 10.

From the above discussion it will be appreciated that the chemical protective poncho system that covers and protects a person from chemical exposure presented herein improves upon the state of the art. More specifically, and without limitation, it will be appreciated that the chemical protective poncho system that covers and protects a person from chemical exposure presented herein: provides a system for a patient that enables mobility; that can be used after injury; allows access for medical staff and equipment without exposing patient; has visual access into and out of the system; prevents claustrophobia, has a permeable surface; can easily open and close; has a port for access; can quickly and efficiently seal a patient; can adapt to other military issue and clothing; can assist a team in handling a patient; works effectively to filter chemical agents; is durable; is robust; is relatively affordable; is lightweight; is portable; has a long shelf life; lasts for a long time once engaged with the patient; is safe; is high quality; among countless other advantages and improvements.

It will be appreciated by those skilled in the art that other various modifications could be made to the device without parting from the spirit and scope of this disclosure. All such modifications and changes fall within the scope of the claims and are intended to be covered thereby.

What is claimed:

1. A chemical protective poncho system, the system comprising:

a body;

the body having a top;

the body having a bottom;

the body having an exterior surface;

the body having an interior surface;

wherein at least a portion of the body is formed of a filter material having a chemical adsorbent material configured and arranged to filter one or more contaminants from air passing through the filter material;

a hood;

the hood having a top;

the hood having a bottom;

the hood having an exterior surface;

the hood having an interior surface;

wherein the hood is operably connected to the top of the body;

wherein at least a portion of the hood is formed of a filter material having a chemical adsorbent material configured and arranged to filter one or more contaminants from air passing through the filter material;

a liner;

the liner having a first end;

the liner having a second end;

the liner having an interior surface;

the liner having an exterior surface;

wherein the second end of the liner is operably connected adjacent the bottom of the body;

a sealing member operably connected adjacent the first end of the liner;

wherein the chemical protective poncho system is configured to be received by a patient such that the hood fits over a head of the patient, the body fits over an upper body of the patient, and the sealing member of the liner seals to the patient while legs of the patient extend out of the bottom of the body, thereby preventing contaminated air from reaching the patient, while allowing the patient to be mobile;

wherein the filter material of the body and the filter material of the hood allow air to enter the chemical protective poncho system while filtering contaminants from the air.

2. The system of claim 1, further comprising a powered air purifying respirator operably connected to the chemical protective poncho.

3. The system of claim 1, further comprising a thread wherein the thread connects the body and the hood at a seam.

4. The system of claim 1, comprising a port, wherein the port is configured to receive an air purifying respirator.

5. The system of claim 1, wherein the body is formed of a left panel and a right panel.

6. The system of claim 1, further comprising a zipper, wherein the zipper is configured to connect a left panel and a right panel of the body of the system.

7. The system of claim 6, further comprising an exterior flap wherein the exterior flap is configured to overlap the zipper.

8. The system of claim 6, further comprising an interior flap wherein the interior flip is operably connected to the interior surface such that the interior flap is configured to overlap the zipper.

9. The system of claim 1, further comprising:

a zipper;

an interior flap; and an exterior flap; wherein the interior flip is operably connected to the interior surface such that the interior flap is configured to overlap the zipper; wherein the exterior flap is operably connected to the exterior surface such that the exterior flap is configured to overlap the zipper.

10. The system of claim 1, wherein the body further comprises an intravenous port configured to provide an opening for access to an interior space of the system from the exterior surface.

11. The system of claim 1, wherein the hood further comprises a window configured to provide a viewable access into and out of the hood.

12. The system of claim 1, wherein the sealing member is a trouser belt.

13. The system of claim 1, further comprising a plurality of arms; wherein the plurality of arms are attached to the body and extend outward from the body; wherein the plurality of arms are configured to provide a plurality of spaces for the patient's arms to extend outside the body.

14. The system of claim 1, wherein the filter material of the body and the filter material of the hood each include a layer of durable water resistance; wherein the durable water resistance layer is configured to repel water from the exterior surface of the body and the exterior surface of the hood and prevent water from reaching the chemical absorbent material.

15. The system of claim 1, wherein the filter material of the body and the filter material of the hood further comprise a high efficiency particulate air (HEPA) layer; wherein the HEPA layer is configured to filter biological contaminants from the air.

16. The system of claim 1, wherein the filter material of the body and the filter material of the hood further comprise a layer of durable water resistance and wherein the filter material of the body and the filter material of the hood further comprise a HEPA layer; wherein the durable water resistance layer is configured to repel water from the exterior surface of the body and the exterior surface of the hood and prevent water from reaching the chemical absorbent material; wherein the HEPA layer is configured to filter biological contaminants from the air.

17. The system of claim 1, further comprising further comprising:

a zipper; and a hook and loop fastener; wherein the hook and loop are configured to enclose the zipper within an exterior flap.

18. The system of claim 1, further comprising:

a zipper; and a hook and loop fastener, wherein the hook and loop are configured to enclose the zipper within an interior flap.

19. The system of claim 1, further comprising a first hook and loop fastener, wherein the first hook and loop fastener are configured to enclose a zipper within an interior flap; and further comprising a second hook and loop fastener wherein the second hook and loop are configured to enclose the zipper within an exterior flap.

20. The system of claim 1, wherein the chemical protective poncho system is configured and arranged to permit a patient wearing the system to breathe through the filter material of the hood.

21. The system of claim 20, wherein the filter material of the body includes activated carbon.

22. The system of claim 21, wherein the activated carbon of the filter material of the body is formed of a layer of activated carbon particles.

23. The system of claim 1, further comprising a thread wherein the thread connects the body and the liner at a seam.

24. The system of claim 1, wherein the liner is non permeable so as to seal the first end of the liner of the chemical protective poncho system.

25. The system of claim 1, wherein an entirety of the body is the filter material.

26. The system of claim 1, wherein:
the hood includes a face shield; and
wherein an entirety of the hood other than the face shield is the filter material.

27. An apparatus, comprising:
a body;
the body having a top;
the body having a bottom;
the body having an exterior surface;
the body having an interior surface;
wherein the body is formed of an chemical adsorbent material;
a hood;
the hood having a top;
the hood having a bottom;
the hood having an exterior surface;
the hood having an interior surface;
wherein the hood is operably connected to the top of the body;
wherein the hood is formed of the chemical absorbent material;
a liner;
the liner having a top;
the liner having a bottom;
the liner having an interior surface;
the liner having an exterior surface;
wherein the top of the liner is operably connected to the bottom of the body;
wherein when the liner is operably connected to the bottom of the body and the hood is operably connected to the top of the body, the apparatus is configured to operably enclose an upper portion of a patient;
a powered air purifying respirator;
wherein the powered air purifying respirator is configured to deliver air through a port and into an interior of the chemical protective poncho system.

28. The apparatus of claim 27, wherein the powered air purifying respirator is configured to deliver air through the port; wherein the port is located in the hood.

29. The apparatus of claim 27, wherein the powered air purifying respirator is configured to provide positive air pressure to an interior of the chemical protective poncho system.

30. The apparatus of claim 27, wherein the powered air purifying respirator includes a chemical adsorbent material configured and arranged to filter chemical contaminants from the air.

31. The apparatus of claim 30, wherein the powered air purifying respirator includes a HEPA filter configured and arranged to filter microbial contaminants from the air.

32. A chemical protective poncho system, the system comprising:
a body;
the body having a top;
the body having a bottom;
the body having an exterior surface;
the body having an interior surface;
the exterior surface of the body having a pocket;
the exterior surface of the body having a first port with a flap;
wherein the first port is configured to receive intravenous tubing;
wherein at least a portion of the body is formed of a filter material having a chemical adsorbent material configured and arranged to filter one or more contaminants from air passing through the filter material;
a hood;
the hood having a top;
the hood having a bottom;
the hood having an exterior surface;
the hood having an interior surface;
wherein the hood is operably connected to the top of the body;
wherein at least a portion of the hood is formed of a filter material having a chemical adsorbent material configured and arranged to filter one or more contaminants from air passing through the filter material;
a liner;
the liner having a first end;
the liner having a second end;
the liner having an interior surface;
the liner having an exterior surface;
wherein the second end of the liner is operably connected adjacent the bottom of the body;
a sealing member operably connected adjacent the first end of the liner;
a powered air purifying respirator;
wherein the powered air purifying respirator is configured to deliver air through a second port and into an interior of the chemical protective poncho system
wherein the chemical protective poncho system is configured to be received by a patient such that the hood fits over a head of the patient, the body fits over an upper body of the patient, and the sealing member of the liner seals to the patient while legs of the patient extend out of the bottom of the body, thereby preventing contaminated air from reaching the patient, while allowing the patient to be mobile;
wherein the filter material of the body and the filter material of the hood allow air to enter the chemical protective poncho system while filtering contaminants from the air.

* * * * *